US005509270A

United States Patent [19]

Pearce et al.

[11] Patent Number: 5,509,270

[45] Date of Patent: Apr. 23, 1996

[54] GAS TURBINE ENGINE COMBUSTOR HEATSHIELD

[75] Inventors: Donald E. Pearce, Bristol; Michael J. Westlake, Charfield, both of England

[73] Assignee: Rolls-Royce plc, London, England

[21] Appl. No.: 393,837

[22] Filed: Feb. 24, 1995

[30] Foreign Application Priority Data

Mar. 1, 1994 [GB] United Kingdom ..... 9403986

[51] Int. Cl.[6] ..... F23R 3/04

[52] U.S. Cl. ..... 60/740; 60/756

[58] Field of Search ..... 60/39.32, 39.36, 60/39.37, 747, 748, 752, 756, 740, 746

[56] References Cited

U.S. PATENT DOCUMENTS

| | | | |
|---|---|---|---|
| 4,322,945 | 4/1982 | Peterson et al. | 60/756 |
| 4,365,470 | 12/1982 | Matthews et al. | 60/39.32 |
| 5,253,471 | 10/1993 | Richardson | 60/39.36 |
| 5,271,220 | 12/1993 | Holmes et al. . | |

FOREIGN PATENT DOCUMENTS 2247522 3/1992 United Kingdom .

*Primary Examiner*—Timothy S. Thorpe
*Attorney, Agent, or Firm*—Oliff & Berridge

[57] ABSTRACT

A gas turbine engine annular combustor has a bulkhead at its upstream end which is protected by an annular array of heatshield segments. The segments are spaced apart from the bulkhead by means of a plurality of flanges. Cooling air apertures provided in the bulkhead direct cooling air into the space between the heatshield and the bulkhead. A portion of the cooling air is directed on to the downstream face of heatshield by means of a plurality of radially extending slots disposed around a fuel nozzle aperture in the centre of each heatshield segment. The slots provide for unrestrained thermal expansion of the heatshield region immediately surrounding the fuel nozzle aperture, thereby to prevent excessive thermal hoop stresses developing in the heatshield during engine operation.

12 Claims, 2 Drawing Sheets

GAS TURBINE ENGINE COMBUSTOR HEATSHIELD

FIELD OF THE INVENTION

This invention relates to gas turbine engine combustor heatshields. In particular the invention concerns gas turbine combustor endwall or bulkhead heatshields.

BACKGROUND OF THE INVENTION

Modern gas turbine annular combustors are usually provided with an upstream endwall or bulkhead which extends radially between inner and outer wall members to define an upstream plenum and a downstream combustion chamber. The bulkhead is usually provided with a plurality of circumferentially spaced apertures, each of which receives an air/fuel injection device for introducing a mixture of air and fuel into the combustion chamber during engine operation.

In order to protect the bulkhead from the direct effects of the combustion process it is often necessary to attach heatshields to the bulkhead structure. In a known arrangement the bulkhead is protected by an annular array of segmented heatshield elements. The segments, which are each associated with one of the air/fuel injection devices, extend both radially towards the inner and outer extents of the bulkhead and circumferentially to abut adjacent segments. The air/fuel injection devices extend into the combustion chamber through corresponding apertures in the heatshield segments. Each heatshield is spaced apart from the bulkhead so that a narrow cooling passage is defined between the two components. In use cooling air is directed into these passages to cool the bulkhead and heatshield components, and then exhausted to the combustion chamber.

In practice it has proved difficult to cool the region of the heatshield immediately surrounding the fuel nozzle aperture without using excessive amounts of cooling air. For structural reasons the various cooling arrangements present in the segments generally become discontinuous in this region. As a result the region surrounding the aperture tends to experience lower levels of cooling and as a result higher temperatures during engine operation. In the prior art arrangements this has lead to excessive thermal gradients being developed in the segments during high temperature combustor operation and, by virtue of the resultant radial temperature distribution, excessive circumferential hoop compression stresses in the region surrounding the fuel nozzle aperture. This has lead to premature failure of the segments in the region of the fuel nozzle aperture by thermal fatigue.

The present invention, therefore, has for one of its objectives to improve the fatigue life of combustor heatshield components, and as a second objective to reduce the amount of cooling air required to cool these components.

SUMMARY OF THE INVENTION

According to the invention a combustor for a gas turbine engine comprising an internal heatshield located in an upstream region of the combustor, the heatshield being formed with an aperture for receiving a fuel nozzle assembly, whereby said aperture is surrounded by a plurality of slots extending in a generally outward direction from the margin of the aperture.

In an arrangement wherein the heatshield comprises a plurality of segments disposed in an annular array, at least one of said segments is formed with a fuel nozzle assembly receiving aperture surrounded by outwardly extending slots.

Preferably in a combustor of the kind referred to the heatshield is spaced apart from an upstream wall of the combustor to define a chamber for receiving cooling air which may exhaust through the slots surrounding the fuel nozzle aperture.

BRIEF DESCRIPTION OF THE DRAWINGS

The invention will now be described in greater detail with reference, by way of example only, to the accompanying drawings, in which.

DETAILED DESCRIPTION OF THE PREFERRED EMBODIMENT

Figure 1:
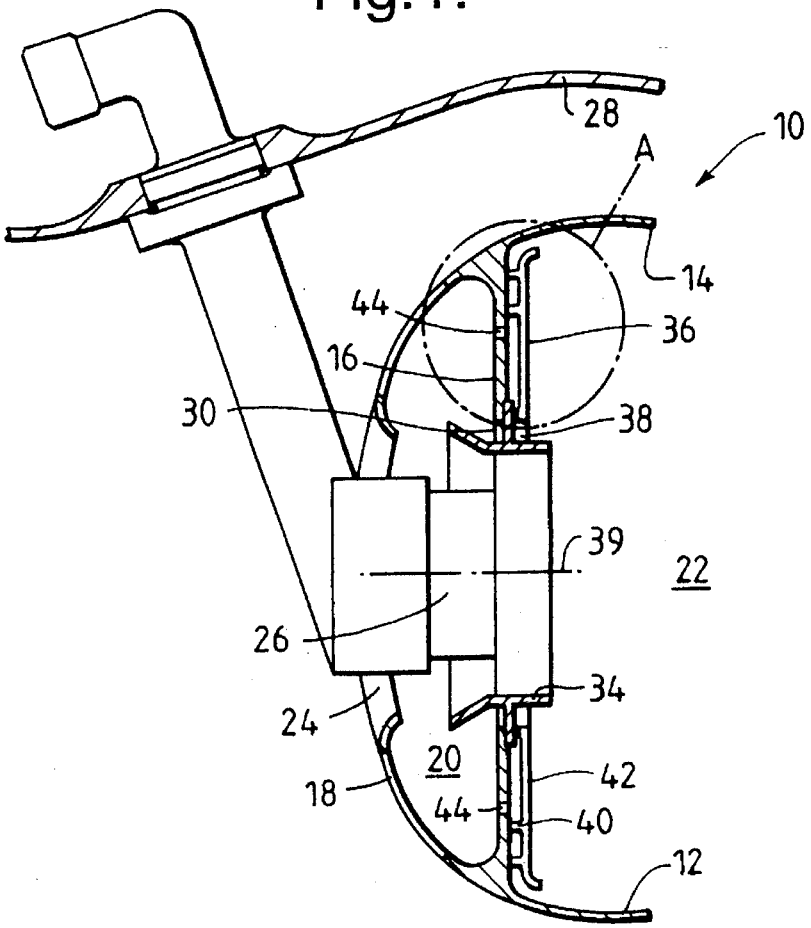
FIG. 1 is a sectioned side view of the upstream end of a combustor having a heatshield in accordance with the present invention.

With reference to FIG. 1, there is shown an upstream part of a gas turbine engine annular combustor 10 of generally conventional configuration. A combustion chamber inner casing comprises radially spaced inner and outer walls, 12 and 14 respectively, interconnected at their upstream ends by means of an annular bulkhead 16. The walls 12 and 14 extend upstream of the bulkhead to form a domed combustor head 18. The bulkhead divides the combustor into an upstream cooling air plenum chamber 20 and a downstream combustion region 22.

Compressor delivery air from an upstream compressor (not shown, but to the left of the drawing) enters the plenum chamber 20 through a plurality of circumferentially spaced inlet apertures 24 before entering combustion chamber 22. Fuel is delivered to the combustion chamber by means of a plurality of air spray type fuel supply nozzles 26. The nozzles are suspended from a combustion chamber outer casing structure 28 and extend into the combustor 10 through a corresponding one of the apertures 24. A corresponding array of circumferentially spaced apertures 30 is provided in the bulkhead member 16, each to receive the outlet of an adjacent one of the nozzles.

An annular seal 34 is positioned between each of the nozzles 26 and the bulkhead apertures 30 in order to prevent leakage of the high pressure combustion air. The seals 34 are slidably mounted with respect to the bulkhead to allow limited radial movement of the nozzles 26 relative to the bulkhead structure. This mounting arrangement provides for unrestrained thermal expansion of the combustor relative to the fuel supply nozzles 26, and as such prevents any unnecessary loading of the components due to differential thermal expansion.

A protective heatshield is mounted on the downstream face of the bulkhead 16 to provide thermal shielding from combustion temperatures. This heatshield has an annular configuration made up of a plurality of abutting heatshield segments 36. The segments, which are of substantially identical form, extend both radially towards the inner and outer walls 12 and 14 of the combustor and circumferentially towards adjacent segments to define a fully annular shield. Some or all of the heatshield segments may be adapted to receive a fuel nozzle. One segment 36 shown in FIG. 2 has provision to receive a single fuel nozzle through fuel nozzle aperture 38, the axis of which is indicated at 39. As shown, the bulkhead and heatshield apertures 30 and 38 are aligned coaxially to accommodate the fuel nozzle assembly of seal 34 and fuel nozzle 26.

The heatshield 36 is spaced a short distance from the bulkhead 16 by flanges 40. The flanges may arranged to form separate chambers 42 behind each heatshield segment or in effect an annular chamber in which the spaces immediately behind the segments are in free communication with each other. The flanges may be formed integrally on the upstream face of the heatshield segment 36, or alternatively on the downstream face of the bulkhead 16. Apertures 44 are formed in the bulkhead 16 to provide passages between the plenum chamber 20 and the spaces 42 between the bulkhead and heatshield. There may be as many of these apertures 44 as necessary of suitable configuration to provide even distribution of cooling air to the rear face of the heatshield 36.

Figure 2:
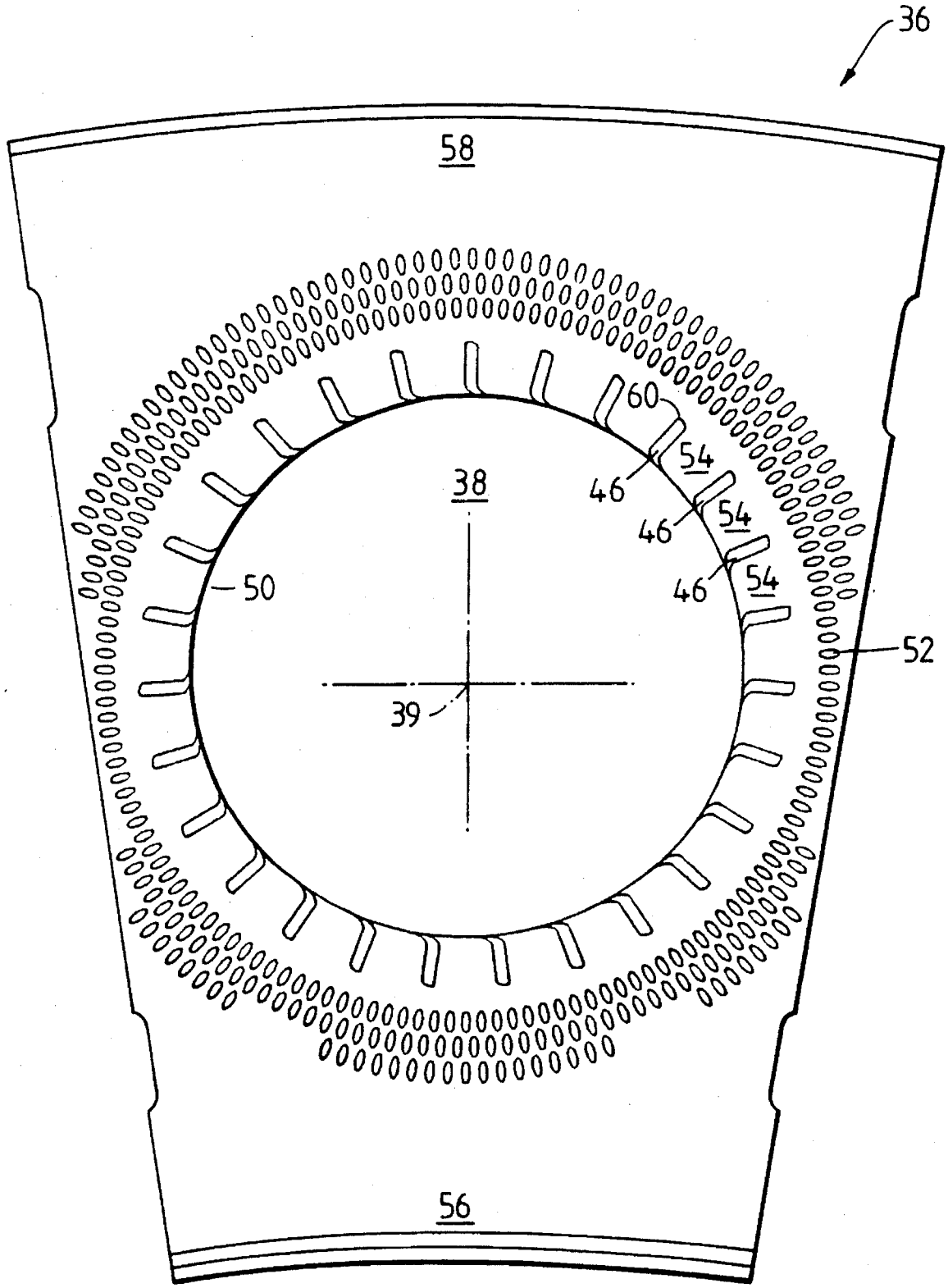
FIG. 2 is an end view of a heatshield segment in accordance with the present invention.

As shown in FIG. 2, the margin of the heatshield surrounding the fuel nozzle aperture 38 is notched. A plurality of slots 46 are equidistantly spaced around the margin of the fuel nozzle aperture 38 and extend in a generally outward direction. These notches form exit passages for air from the space between the bulkhead and the heatshield. In the illustrated embodiment the slots extend radially outwards, but may angled relative to a radius if desired. The length of slots 46 is chosen with regard to the radial temperature gradient in the heatshield segment during operation.

The slots 46 effectively destroy the hoop stiffness of the heatshield immediately adjacent the fuel nozzle aperture, and hence reduce the circumferential load carrying capability, of the bore region. The slots provide for unrestrained thermal expansion of the stubs 54 during high temperature engine operation. The bore region may, therefore, operate at temperatures in excess of those experienced elsewhere in the heatshield without inducing damaging circumferential thermal fatigue stresses in the heatshield structure 36, in particular the region surrounding the fuel nozzle aperture 38.

The slots may extend outwards from the bore by an amount equal to or greater than the whole or greater extent of the radial temperature gradient. Then hoop stresses may be substantially prevented from developing in the heatshield during operation. Typically, however, the slots will not extend so far and low levels of hoop stress may be permitted to develop in the heatshield outward of the slots. Essentially, therefore, the radial length of the slots will be affected, for each application, by factors such as heatshield fatigue life and the thermal fatigue properties of the heatshield material.

In order to avoid excessive stress concentrations at their outer extremities 60, the slots may be formed with a keyhole section. Furthermore the slots 46 may be angled relative to the downstream face of the heatshield as a way of exposing maximum surface area of the heatshield to cooling air as it discharges through the slots 46. This also imparts a swirl component to the exiting air so that it discharges into the combustion chamber with a tangential component, as a film, over the downstream surface of each of the stubs 54. The radial extremity 60 of each slot 46 may be similarly angled radially outwards to lay cooling air over the heatshield segment between the slots and the first ring of cooling holes.

The heatshield may also incorporate further film cooling holes 52. In the illustrated embodiment, these cooling holes 52 are arranged in several rings concentric with the fuel nozzle assembly aperture and allow cooling air from the space behind the heatshield to discharge a protective film across the downstream face of the heatshield. The slots 46 extend part way outwards towards a first of these rings of cooling holes. The cooling holes may be angled with respect to the surface of the heatshield. They may, for example, be inclined radially outwards relative to a perpendicular to the heatshield surface and also, if desired, with a tangential component of direction. Thereby air in the protective surface film may be induced to flow generally outwards and may receive a degree of swirl. The swirl may be in the same sense as the swirl of air exiting the slots 46.

In use, the cooling air exhausts from plenum 20 into chamber 42 through the entry holes 44 in the bulkhead 16. The cooling air passing through these holes impinges against the upstream, or rear, face of the heatshield 36, and then continues over the internal surfaces which define the chamber before exiting to the combustion chamber 22 either through film cooling holes 52 or through the slots 46. In accordance with the invention a portion of the cooling air exits chamber 42 through the slots 46. Slots 46 emit an envelope of cooling air to the region surrounding the fuel nozzle aperture 38.

Figure 3A:
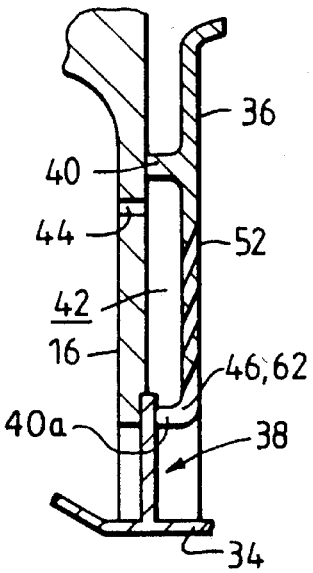
FIG. 3*a* is a detailed section view of area A shown in FIG. 1.
Figure 3B:
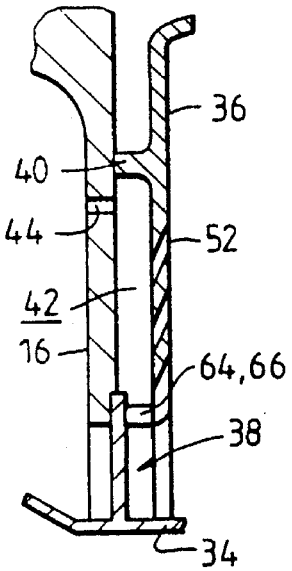
FIG. 3*b* is a corresponding detail view of the same region in an alternative which uses a spacer ring instead of a heatshield flange.

Referring now to FIG. 3*a*, the radially inner flange 40*a* extends coaxially around the fuel nozzle aperture 38. A plurality of circumferentially spaced apertures 62 are provided in the flange for restricting the flow of cooling air radially inwards towards the seal member 34 belonging to the fuel nozzle assembly. In the embodiment shown flange 40*a* is formed integrally with the heatshield. The slots 46 extend into the flange 40*a* to maintain the discontinuity of the bore 50, and as such define the flow control apertures 62. As shown in FIG. 3*b*, in an alternative arrangement flange 40*a* may be substituted by a separate spring ring 64 having appropriately sized apertures 66 which preferably are but may not be aligned with the slots 46 in the heatshield when assembled together.

We claim:

1. A combustor for a gas turbine engine comprising a cylindrical radial inner wall, a cylindrical radial outer wall, an upstream bulkhead wall extending between said inner and outer walls, and an internal heatshield located on a downstream face of said upstream bulkhead wall and spaced therefrom to create a passageway for cooling air, each of the internal heatshield and the upstream bulkhead wall being formed with a fuel nozzle aperture therethrough, a fuel nozzle seal ring located concentrically within each fuel nozzle aperture in the upstream bulkhead wall and the internal heatshield, wherein the internal heatshield is formed with a plurality of heatshield slots extending in a generally outward direction from a circumference of each fuel nozzle aperture, said plurality of heatshield slots defining a plurality of exit apertures for cooling air in the passageway for cooling air behind the internal heatshield.

2. A combustor as claimed in claim 1, wherein the internal heatshield comprises a plurality of segments disposed in an annular array and at least one of said segments is formed with said fuel nozzle aperture for receiving said fuel nozzle seal ring.

3. A combustor as claimed in claim 1, wherein the internal heatshield further comprises a flange formed concentrically with each fuel nozzle aperture, said flange extending toward the upstream bulkhead wall.

4. A combustor as claimed in claim 3, wherein the flange formed concentrically with each fuel nozzle aperture further comprises flange slots that open into the outwardly extending heatshield slots formed in the internal heatshield.

5. A combustor as claimed in claim 4 wherein the flange slots are angled relative to a downstream facing surface of the heatshield.

6. A combustor as claimed in claim 1 wherein the heatshield is provided with a multiplicity of further cooling holes disposed in arrays surrounding the or each fuel nozzle aperture outwards of the heatshield slots surrounding said fuel nozzle aperture.

7. A heatshield for a combustor for a gas turbine engine comprising a cylindrical radial inner wall, a cylindrical radial outer wall, an upstream bulkhead wall extending between said inner and outer walls, and an internal heatshield located on a downstream face of said upstream bulkhead wall, said internal heatshield being spaced from the upstream bulkhead wall to create a passageway for cooling air, the internal heatshield and the upstream bulkhead wall being formed with a plurality of fuel nozzle apertures therethrough, fuel nozzle seal rings located concentrically within respecting ones of said fuel nozzle apertures in the upstream bulkhead wall and the internal heatshield, wherein the internal heatshield includes a plurality of heatshield slots surrounding each of said fuel nozzle apertures, said plurality of heatshield slots extending in a generally outward direction from a circumference of the fuel nozzle aperture and forming a plurality of exit apertures for cooling air in the passageway for cooling air behind the internal heatshield.

8. A heatshield as claimed in claim 7, further comprising a plurality of part annular segments arranged in an annular array wherein several of the segments have formed therethrough said fuel nozzle apertures for receiving said plurality of fuel nozzle seal rings.

9. A heatshield as claimed in claim 8, further comprising a flange surrounding each of said fuel nozzle apertures for receiving said fuel nozzle seal rings.

10. A heatshield as claimed in claim 9, wherein each flange is formed with generally axially extending flange slots that open into the outwardly extending heatshield slots surrounding each of said fuel nozzle apertures receiving fuel nozzle seal rings.

11. A heatshield as claimed in claim 10 wherein the generally axially extending flange slots are angled relative to an annular face of the internal heatshield.

12. A heatshield as claimed in claim 11, wherein a plurality of further cooling holes are disposed in arrays surrounding each of said fuel nozzle aperture that receives a fuel nozzle seal ring outwardly of the heatshield slots surrounding each of said fuel nozzle aperture.

* * * * *